US008950327B2

(12) United States Patent
Boskovic

(10) Patent No.: US 8,950,327 B2
(45) Date of Patent: Feb. 10, 2015

(54) METHOD OF PRINTING ONTO A SUBSTRATE

(75) Inventor: Brandon Boskovic, Elmhurst, IL (US)

(73) Assignee: Lingraph, Glendale Heights, IL (US)

( * ) Notice: Subject to any disclaimer, the term of this patent is extended or adjusted under 35 U.S.C. 154(b) by 0 days.

(21) Appl. No.: 13/313,285

(22) Filed: Dec. 7, 2011

(65) Prior Publication Data

US 2013/0145947 A1 Jun. 13, 2013

(51) Int. Cl.
*B42D 15/00* (2006.01)
*G03G 15/00* (2006.01)

(52) U.S. Cl.
USPC ..... 101/483; 101/36; 399/401

(58) Field of Classification Search
CPC . B42D 15/00; B42D 15/0073; B42D 15/0086
USPC ..... 101/483, 36; 399/401; 374/103; 347/103, 106
See application file for complete search history.

(56) References Cited

U.S. PATENT DOCUMENTS

| | | | | |
|---|---|---|---|---|
| 4,771,319 | A * | 9/1988 | Hamakawa | 399/364 |
| 5,335,005 | A * | 8/1994 | Sellers | 347/139 |
| 6,256,105 | B1 * | 7/2001 | Nobuaki et al. | 358/1.15 |
| 6,698,877 | B2 | 3/2004 | Urlaub et al. | |
| 7,037,575 | B2 | 5/2006 | Forry et al. | |
| 2004/0143231 | A1 | 7/2004 | Nair et al. | |
| 2006/0070701 | A1 | 4/2006 | Kobayashi et al. | |
| 2007/0239126 | A1 | 10/2007 | Wilson et al. | |
| 2008/0266366 | A1 * | 10/2008 | Kersey et al. | 347/85 |
| 2009/0162125 | A1 * | 6/2009 | Kubota | 400/611 |
| 2010/0125499 | A1 | 5/2010 | Cuch et al. | |

OTHER PUBLICATIONS

"Printing your photo on tissue paper" by Yngla published on various dates ranging from Nov. 2008 to Aug. 2010 available at http://www.instructables.com/id/How-to-make-a-unique-tile-picture-for-less-than-3/step4/Printing-your-photo-on-tissue-paper/.*

"HP Indigo W7200 Digital Press" by HP published on Sep. 2008.*

ULINE Shipping Supply Specialists, Custom Printed Tissue Paper [online], [retrieved on Apr. 9, 2012]. Retrieved from the Internet <URL:http://www.uline.com/CustomProduct/CustomStaticTissuePaper.htm? pricode=wr690 &gclid=CLf8yeGaxaoCFUEDQAod_BXH4Q>.

ModernArts Tissue, Custom Printed Tissue [online], [retrieved on Apr. 9, 2012]. Retrieved from the Internet <URL:http://www.printedtissue.com/>.

Nashville Wraps, Printed Tissue Paper [online], [retrieved on Apr. 9, 2012]. Retrieved from the Internet <URL: http://www.nashvillewraps.com/printed-tissue-paper/showpage.ww?page=printedtissue>.

Satin Wrap Premium Quality Wrapping Tissue, Custom Printing [online], [retrieved on Apr. 9, 2012]. Retrieved from the Internet <URL:http://www.satinwrap.com/2011/custom.php>.

(Continued)

*Primary Examiner* — Blake A Tankersley
(74) *Attorney, Agent, or Firm* — McDonnell Boehnen Hulbert & Berghoff LLP

(57) ABSTRACT

A method for printing is disclosed. In one embodiment the method is performed by a digital printer. A substrate is secured to a front side and a back side of a liner sheet. The lined substrate is fed into the digital printer, and an image is printed onto both the front side and the back side of the lined substrate. In one embodiment, the substrate may include a tissue.

18 Claims, 3 Drawing Sheets

(56) References Cited

OTHER PUBLICATIONS

You Tube, New Decoupage Workshop—How to print on tissue paper [online video], [retrieved on Apr. 9, 2012]. Retrieved from the Internet <URL:http://www.youtube.com/watch?v=tklyU6kJm-U>.

Linda Matthews Creative Explorer, Printing on Tissue Paper [online video], [retrieved on Apr. 9, 2012]. Retrieved from the Internet <URL:http://www.satinwrap.com/2011/custom.php>.

You Tube, Print on Tissue Paper [online video], [retrieved on Apr. 9, 2012]. Retrieved from the Internet <URL:http://www.youtube.com/watch?v=OzKJJTiP-pU>.

* cited by examiner

METHOD OF PRINTING ONTO A SUBSTRATE

FIELD OF THE APPLICATION

The present application relates generally to a method of printing onto a substrate, and more particularly, to a method of printing onto a tissue.

BACKGROUND

There are different ways of printing an image onto a substrate. Digital printing refers to methods of printing from a digital based image directly to a variety of media. One difference between digital printing and traditional printing methods is that no printing plates are used, resulting in a quicker and less expensive turn-around time. Well-known digital printing methods include inkjet or laser printers that deposit pigment or toner onto a wide variety of substrates including paper, photo paper, canvas, glass, metal, marble, and other substances.

Offset printing is a commonly used printing technique in which an inked image is transferred (or "offset") from a plate to a rubber blanket, then to the printing surface. Offset printing has evolved to digital offset printing. In digital offset printing, like offset printing, the water and ink do not mix. Industrial inks are used, and usually set on a commercial printing press with the guidance of computers. Digital offset printing provides more customization options.

Digital offset printing can be performed using a digital offset printing press. Generally, the substance or material run through the digital printing press has a thickness large enough to withstand the forces of the press.

SUMMARY

The present application provides a method of printing. In one embodiment, the method includes providing a digital printer, securing a substrate to a front side and a back side of a liner sheet, feeding the lined substrate into the digital printer, and printing an image onto both the front side and the back side of the lined substrate. In one embodiment, the substrate may include a tissue.

In another embodiment, a tissue is provided including an image printed onto the tissue by a digital printer when the tissue is wrapped around a liner sheet. The image bleeds off of an edge of the tissue.

In yet another embodiment, a method of printing onto a tissue is provided. The method includes folding a tissue over a liner sheet, thereby creating a front side of the tissue and a back side of the tissue, feeding the lined tissue into a printer, and printing an image onto both the front side and the back side of the lined tissue. A first portion of the image is printed onto the front side and a second portion of the image is printed onto the back side.

These as well as other aspects and advantages will become apparent to those of ordinary skill in the art by reading the following detailed description, with reference where appropriate to the accompanying drawings. Further, it should be understood that the embodiments described in this summary and elsewhere are intended to illustrate the invention by way of example only.

BRIEF DESCRIPTION OF THE FIGURES

Exemplary embodiments of the invention are described herein with reference to the drawings, in which.

DETAILED DESCRIPTION

Figure 1:
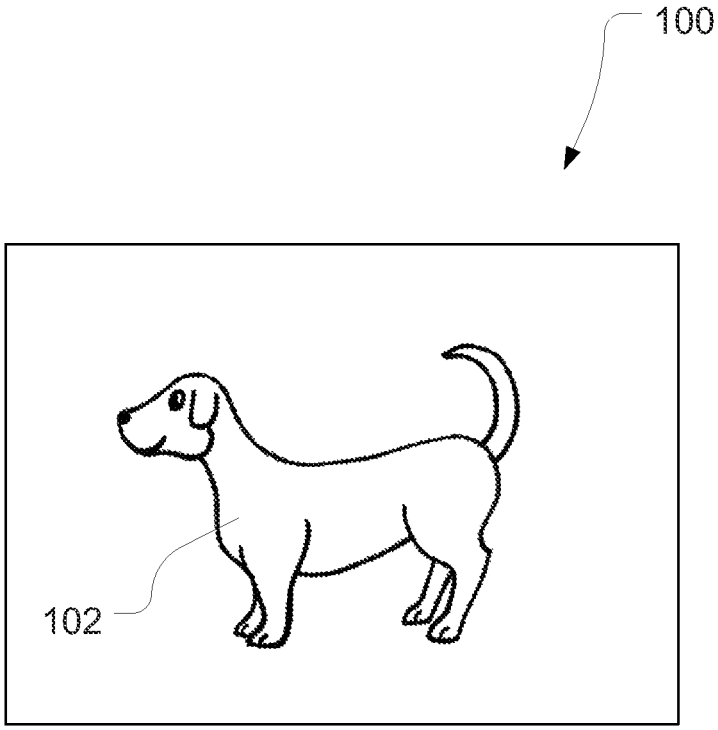
FIG. 1 is a perspective view of an example printed substrate of the present application.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The present application provides a method for printing onto a substrate, such as a tissue. In an example embodiment, the method includes printing onto the substrate using a digital printing press.

Turning now to the drawings, FIG. 1 shows an exemplary printed substrate 100, which may be a tissue, for example. The substrate can be wrapping tissue paper or any other type of substrate that has a thickness range of about 0.03 mm to about 0.15 mm. The substrate 100 may be printed with a custom image 102, per a customer's request, for example. In one embodiment, a digital offset printer may be used to print the image or images onto the substrate.

Figure 4:
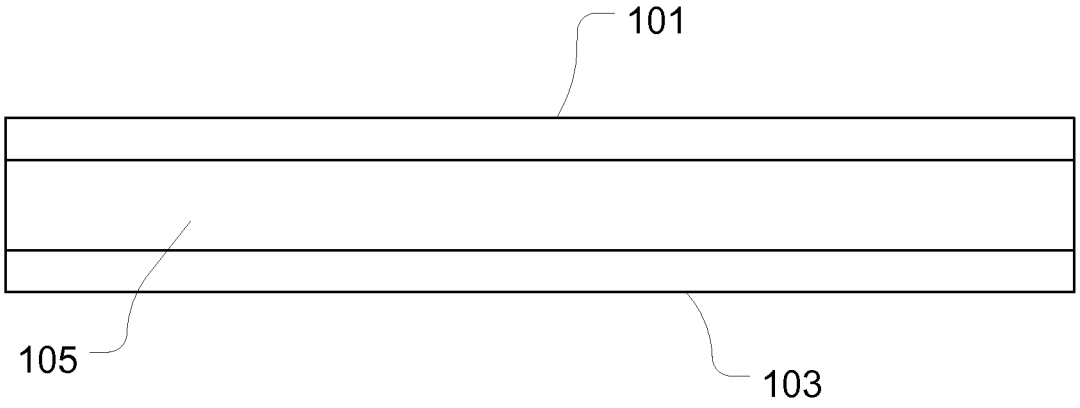
FIG. 4 is a cross-sectional view of the substrate shown in FIG. 1.

In an exemplary method, an unprinted substrate, such as a tissue, is wrapped around a liner sheet 105, shown in FIG. 4, which provides support and stability to the substrate 100. The liner sheet may be made of any material that is thick and stable enough to be fed through a printing press, such as printing paper or cardstock, for example. The thickness of the substrate and liner combined may be from about 3 pt to about 14 pt (0.1 mm-0.35 mm).

In order to prepare the substrate 100 for printing, the substrate 100 is secured to both a front side and a back side of the liner sheet 105. Thus, a front side 101 of the substrate and a back side 103 of the substrate are created, which can be seen in FIG. 2. In one example, the substrate 100 is secured to the liner sheet by an adhesive, such as glue or tape, for example. Alternatively, the substrate may be secured to the liner sheet by any known fastening method. In one embodiment, the adhesive may be applied up to one or more of the edges of the substrate. In another embodiment, in order for the press to properly pick up the lined sheets, the adhesive may be applied at least about ¼ inch from an edge of the substrate. In yet another embodiment, the adhesive may be applied between about ¼ inch and ½ inch from an edge of the substrate. Other possibilities exist as well.

Figure 5:
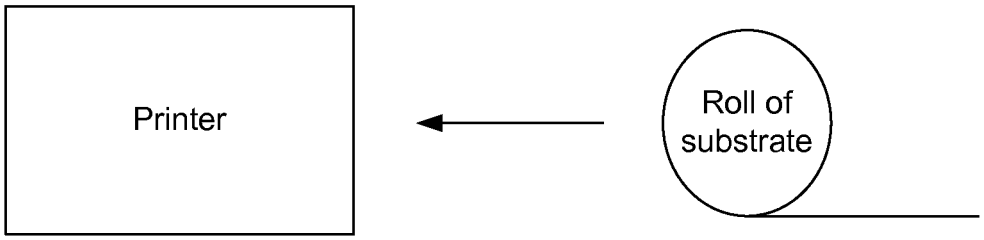
FIG. 5 shows a roll of substrate being fed into a printer.

The lined substrate is then fed through a digital printing press, which may be a digital offset printing press, as described below, and as shown in *Fig.* 2. In another embodiment, the lined substrate may be used with a large high-speed digital inkjet web press. The lined substrate may be sheet fed, such as by feeding one sheet of the substrate into the press at a time, or web fed, such as by feeding a continuous roll of the substrate into the press (shown in FIG. 5).

Figure 2:
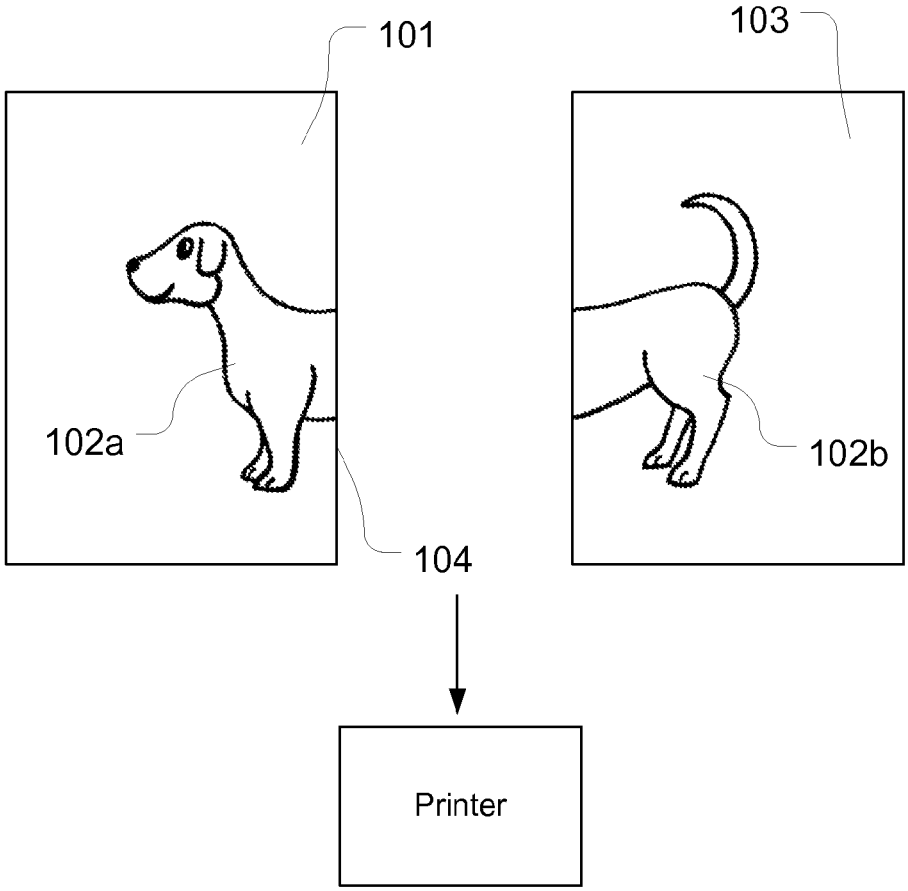
FIG. 2 is a perspective view of a front and back side of the folded substrate shown in FIG. 1.
Figure 3:
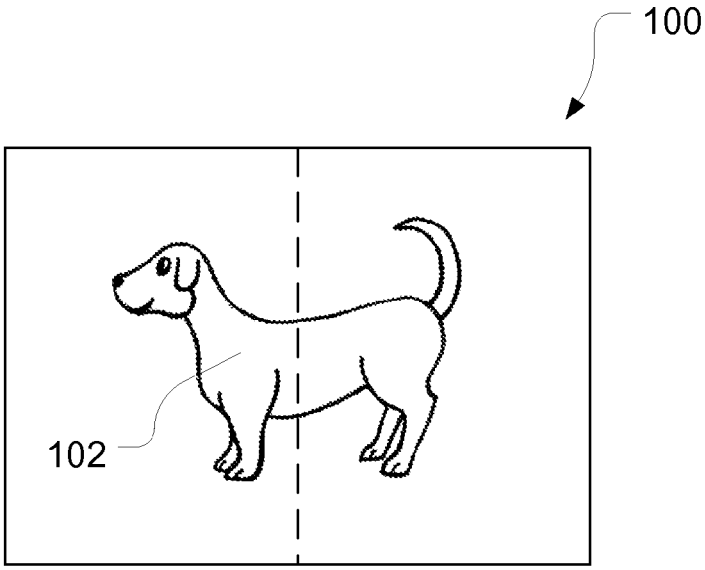
FIG. 3 is a perspective view of the unfolded substrate shown in FIG. 1.

In one embodiment, a single image 102 is printed onto both the front side and the back side of the lined substrate, as shown in FIG. 2. In an example embodiment, a first portion of the image 102*a* is printed onto the front side 101 of the substrate, and a second, different portion of the image 102*b* is printed onto the back side 103 of the substrate. The image 102 may be printed up to or on the folded edge 104 of the substrate, and may also bleed off of the edge 104. Thus, when the substrate is removed from the liner sheet and unfolded, as shown in FIG. 3, a single continuous image 102 is present on the substrate 100. In another embodiment, the same image may be printed onto the front side 101 as on the back side 103.

In some embodiments, the digital offset printing press may be an HP® Indigo Series printing press, for example. HP® Indigo Series printing presses use a modified version of offset printing to image paper. In other embodiments, other digital offset printing presses may used.

Depending on the model of the press, the paper or substrate to be printed is fed either from a paper drawer, a pile feeder with suction fingers, or from a roll feeder.

In an exemplary printing method, the printing process begins by a user entering the dimensions of the substrate 100 into the press. In one embodiment, a dimension greater than an actual dimension of the substrate is inputted into the digital offset printing press. For example, the width may be entered as wider than the actual width of the substrate 100. This allows ink to bleed over the edge of the substrate and to stick to the edge of the substrate.

Art files of the images to be printed are entered into the press as 2 page PDFs. The "duplex" option is selected to ensure printing on both sides of the substrate 100. A file is set up in the press which reads the image 102 as two separate images. When the file is created, an art program, such as Corel Draw, Indesign, or Quark Express, for example, splits the design of the image in half, into a first portion and second portion (Page 1 and Page 2).

The "tumbled" option on the press may also be selected, which tells the press to flip the substrate over before printing. This means that the press matches the two art files (front and back) so the top of the pages are both at the top of the substrate. The tumbled option is selected so the first and second portions of the image match up properly. A stacking order option may also be selected, which decides the order in which the press prints the substrate. Any stacking order may be used.

In some situations a "transparent" option on the press may be selected, if available, which informs the press that the substrate may include more than one layer. When applicable, this option prevents the press from rejecting the lined substrate, and allows it to run without frequent jams.

The lined substrate is then positioned in the press. Each page of the file (both front and back sides of the substrate) is centered vertically and placed as far over to the folded side of the sheet as possible to facilitate the image being printed off of the folded edge.

If an HP® Indigo Series press is used, the printing process then may begin with a laser "writing" an electrical charge onto a plate wrapped around a large cylinder. As the cylinder spins and the image is written, oppositely charged ink particles are attracted from the inking system. The inking system may include a series of ink bid rollers or injectors. An ink is then deposited onto a heated offset blanket, which is spinning on its own cylinder, by attracting it with a higher electrical charge than the plate cylinder.

A sheet of the substrate is fed and gripped by an impression cylinder. The image on the blanket is then offset onto the substrate spinning around the impression cylinder by reversing the electrical charge to repel the ink, and the heat and pressure between the two drums ensure the ink sticks to the substrate.

The process then repeats for the next color separation with the substrate remaining on the impression cylinder until all colors are complete (process colors and/or spot colors).

In another embodiment, referred to as "one-shot" technology, all the colors are built up onto the blanket on top of each other and then laid on the paper at once. This allows plastic substrates (which tend to warp from repeated exposure to heat and pressure) and the web (because its continuous and can't wrap around a cylinder) to be imaged.

The sheet or roll is then fed out to a stacker or take-up reel. The printed substrate is cut down to its final size effectively removing the adhesive and releasing the tissue from the liner. This can be done with a guillotine cutter (sheet fed) or with a rewind slitter (web fed).

Some advantages of the method of the present application include the ability to produce short run orders while still being cost effective, quicker product turnarounds, the ability to produce designs with variable data, and easily creating full color images with relatively no additional cost.

Various example embodiments have been described. The present disclosure is not to be limited in terms of the particular embodiments described in this application, which are intended as illustrations of various aspects. For example, any type of printer may be used, whether a digital offset printer, industrial ink-jet press, or any other type of printer that will work with the inventive methods. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. Further, many of the elements that are described are functional entities that may be implemented as discrete or distributed components or in conjunction with other components, in any suitable combination and location.

The invention claimed is:

1. A method of printing comprising:

providing a digital offset printer;

folding a substrate around a front side and a back side of a liner sheet, creating a 3-ply lined substrate;

feeding the 3-ply lined substrate into the digital offset printer; and printing an image onto both the front side and the back side of the 3-ply lined substrate, wherein the digital offset printer is capable of printing at least 4000 single color 8.5×11 in. prints per hour or 68 single color linear feet per minute.

2. The method of claim 1 wherein a different image is printed onto the front side of the lined tissue than on the back side of the lined tissue.

3. The method of claim 1 wherein the same image is printed onto the front side of the lined tissue as on the back side of the lined tissue.

4. The method of claim 1 wherein a single image is printed onto both the front side and the back side of the lined tissue, and wherein a first portion of the image is printed onto the front side and a second portion of the image is printed onto the back side.

5. The method of claim 1 wherein the image bleeds off of only a folded edge of the tissue.

6. The method of claim 1 wherein the substrate is secured to the liner by an adhesive.

7. The method of claim 6 wherein the adhesive is applied at least about ¼ inch from an edge of the substrate.

8. The method of claim 6 wherein the adhesive is applied up to an edge of the substrate.

9. The method of claim 6 wherein the adhesive is glue.

10. The method of claim 6 wherein the adhesive is tape.

11. The method of claim 6 wherein the adhesive is applied to both the front side and the back side of the liner sheet.

12. The method of claim 1 wherein the substrate is tissue paper.

13. The method of claim 1 wherein the substrate is sheet fed into the digital offset printer.

14. The method of claim 1 wherein the substrate is roll fed into the digital offset printer.

15. A method of printing onto a tissue using a high-speed digital printing press comprising:

folding the tissue around a front side and a back side of a liner sheet and securing the tissue to the liner sheet with an adhesive, creating a lined tissue;

feeding the lined tissue into the high-speed digital printing press;

inputting a dimension greater than an actual dimension of the lined tissue into the high-speed digital printing press;

entering images to be printed as two page files into the high-speed digital printing press; and printing an image onto both the front side and the back side of the lined tissue, wherein the high-speed digital printing press is capable of printing at least 4000 single color 8.5×11 in. prints per hour or 68 single color linear feet per minute.

16. The method of claim 15 wherein a first portion of the image is printed onto the front side of the lined tissue and a second portion of the image is printed onto the back side of the lined tissue.

17. The method of claim 15 wherein the adhesive is applied at least about ¼ inch from an edge of the tissue.

18. The method of claim 15 wherein the adhesive is applied up to the folded edge of the tissue.

* * * * *